United States Patent [19]

Aylesworth

[11] 3,997,094

[45] Dec. 14, 1976

[54] DEVICE FOR ALIGNING POWER PRESS FEEDSTOCK

[76] Inventor: Albert Orser Aylesworth, 3050 Alexander Blvd., Windsor, Ontario, Canada

[22] Filed: Mar. 10, 1976

[21] Appl. No.: 665,503

[52] U.S. Cl. ..... 226/19; 226/23

[51] Int. Cl.[2] ..... B65H 25/26

[58] Field of Search ..... 226/18, 19, 20, 21, 226/22, 23

[56] References Cited

UNITED STATES PATENTS

| | | | |
|---|---|---|---|
| 3,390,823 | 7/1968 | Ott | 226/19 |
| 3,848,788 | 11/1974 | Buta | 226/19 |

*Primary Examiner*—Richard A. Schacher

[57] ABSTRACT

A device is described for aligning coiled sheet material in the die of a power press during stamping operations. It includes a coiled sheet material feeder having a pair of powered gripping rollers for gripping and advancing the sheet material, these rollers being mounted on a head portion which is supported on a base with the feeder head being arranged to pivot on the base about a vertical axis and to move on the base laterally to the direction of travel of the sheet material while being fixed against movement parallel to the direction of travel of the sheet material. Hydraulic cylinders are provided for separately laterally moving forward and rearward portions of the feeder head and these are operatively connected to detector means, such as feeler actuated solenoid valves positioned along one side of the travel path of the sheet material between the feeder head and power press. These detector means sense the edge of the sheet material passing through the power press and cause the feeder head to laterally adjust and/or pivot to maintain the sheet material in proper alignment within the press.

14 Claims, 5 Drawing Figures

DEVICE FOR ALIGNING POWER PRESS FEEDSTOCK

BACKGROUND OF THE INVENTION

1. Field of the Invention

This invention relates to a device for aligning coiled sheet material being fed to a die of a power press during stamping operations.

2. Description of the Prior Art

In the production of work pieces from coiled sheet material, such as coils of sheet steel, the coil is normally placed in a cradle and predetermined lengths of this coil of sheet material are intermittently advanced into a power press. The problems associated with control of the forward advancement of the sheet material have been largely overcome by modern feeders such as that described in U.S. Pat. No. 3,771,703. These feeders utilized gripping rollers between which the sheet material is pinched with the rollers preferably being powered by hydraulic motors.

A typical power press is a frame structure which provides a feed path for the sheet material between relatively moveable tool-carrying members so that the tools or dies carried by the latter can act on the sheet material to form the work pieces. One of the tool-carrying members is normally in the form of a ram moveable rectilinearly along a guide path in a direction toward and away from another tool-carrying member forming a bed on the frame structure. The drive means for the ram normally comprises the flywheel operatively connected through a clutch with an eccentric element such as crank, cam or eccentric serving to impart the required movement to the ram.

It will be appreciated that in order to pull sheet material through the feeder in an accurate manner, there must be a very large pressure on the gripping rollers of the feeder. Moreover, if the sheet material is not well centered in these rollers and equal pressure applied across the sheet material, there is a tendency for corrugations to form along the edges of the material. Moreover, it is both difficult and time consuming to try to align the die of the power press completely accurately with the feeder, with the result that frequently there is a small degree of non-alignment which again causes deformation of the edge of the sheet material. When this occurs, it may be necessary to shut down the system and attempt to do further realigning manually until no further indications of non-alignment are in evidence.

Another situation which normally creates problems is where the steel from the rolling mill or slitting mill contains a camber, i.e. a deviation from straight line. Here again it becomes necessary to shut down the system and try to make adjustments so that the alignment will be proper to take into account the camber and thereby avoid damaging the edges of the sheet material.

It is therfore, the object of the present invention to provide a system to automatically adjust the alignment of the feeder so that the sheet material at all times will be in full alignment within the press.

SUMMARY OF THE INVENTION

Thus, according to the present invention there is provided a device for feeding a coil of sheet material to a power press. The device comprises:

a. a feeder for intermittently advancing predetermined lengths of the sheet material along a feed path, this feeder having a pair of power gripping rollers for gripping and advancing the sheet material, with these rollers being mounted on a head portion which is supported on a base with the feeder head being arranged to pivot on the base about a vertical axis and to move on the base laterally to the direction of travel of the sheet material while being fixed against movement parallel to the direction of travel of the sheet material, b. powered means for separately, laterally moving forward and rearward portions of the feeder head, and c. detector means mounted between the power press and the feeder head for detecting the edge of the sheet material, including at least two detector means spaced longitudinally to the direction of travel of the sheet material and arranged to both detect the same edge of the sheet, these detector means being operatively connected to actuate the powered means for laterally moving the feeder head, whereby the feeder head laterally adjusts and/or pivots to maintain the sheet material in proper alignment within the power press feed path.

DESCRIPTION OF THE PREFERRED EMBODIMENTS

According to a preferred feature, the powered means for laterally moving forward and rearward portions of the feeder head are in the form of double acting hydraulic cylinders. Thus, one such cylinder is connected between a forward portion of the feeder head and the supporting base while a second such cylinder is connected between a rearward portion of the feeder head and the supporting base.

The hydraulic cylinders on the feeder head are operatively connected to the detector means mounted between the feeder head and the power press. The detector means are preferably in the form of solenoid valves positioned in spaced relationship along one side of the travel path of the sheet material. The solenoid valves have projecting pins which are engaged by a floating edge guide or feeler which detects the edge of the sheet material.

These solenoid valves control the direction of flow of fluid through the hydraulic cylinders on the feeder head with each of the solenoid valves controlling one of the cylinders. Thus, as the feeler moves laterally in response to the position of the edge of the sheet material, the valve pins are depressed and released in response to the feeler. Each depression and release of a pin in turn reverses the direction of flow of fluid through the hydraulic cylinder on the feeder head, causing a shuttling action of the feeder head in response to movements of the feeler. In other words, the combination of the pair of solenoid valves with the floating edge guide makes it possible to shift the feeder head in any desired direction so that the sheet metal being fed to the press will be maintained in proper alignment at all times.

Certain preferred embodiments of the invention will now be described by way of example with reference to the accompanying drawings in which.

Figure 1:
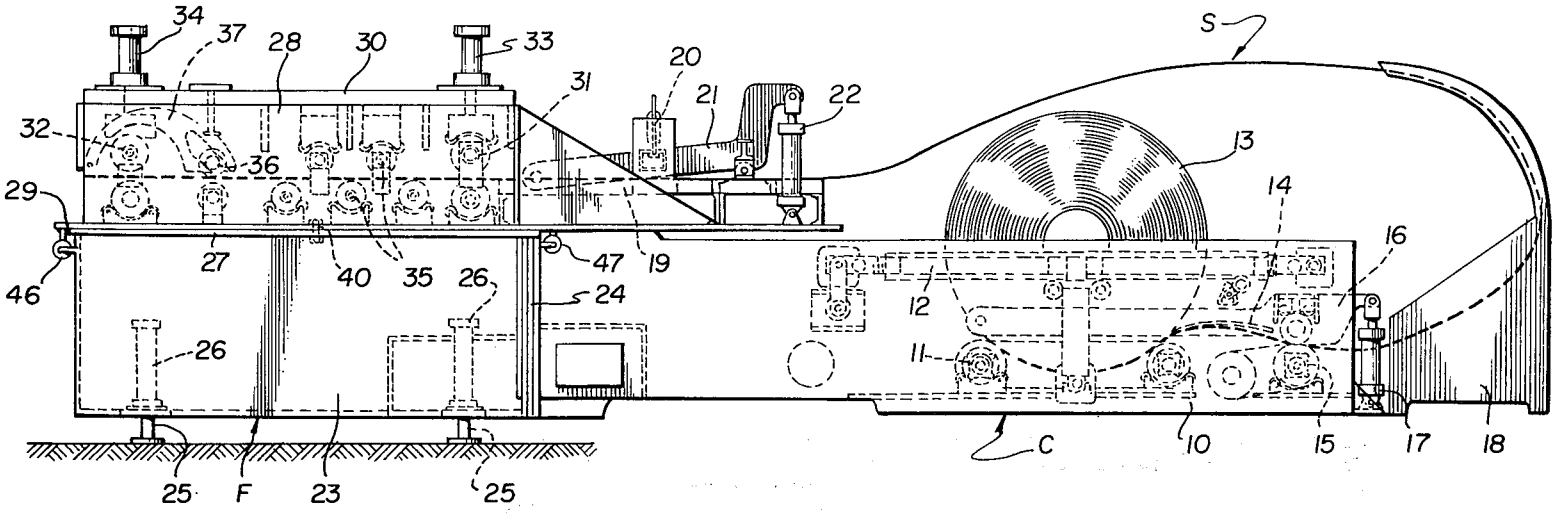
FIG. 1 is a side elevation of typical cradle and feeder for coiled sheet metal.

A commercial machine for which the present invention is eminently suitable is the Anclay Feeder. FIG. 1 shows a feeder F connected to a cradle C. The cradle has heavy steel side walls 10 across between which extend powered support rollers 11 for supporting and uncoil a coil of sheet steel 13. The coil is held in proper alignment on the rollers 11 by means of rollers 12 positioned on each side of the coil. A peeler blade 14 is mounted on an arm 16 which is vertically adjustable by means of a cylinder 17 is used for peeling the first layer of sheet material away from the coil and this then passes between pinch rollers 15. Both the pinch rollers 15 and the support rollers 11 are powered and these together serve to uncoil the coil of sheet metal. The uncoiled strip of metal S loops around a rearwardly positioned guide 18 up over the coil 13 and onto a support table 19 and forward region of the cradle C. A clamping mechanism 20 is mounted on a vertically swingable arm 21 actuated by cylinder 22 and this clamp 20 is used to clamp and hold the tail end of one of the coils of sheet metal and the leading end of a new coil so that they may be welded at this point and then drawn through the feeder head in starting a fresh coil.

The feeder F has a base 23 made from heavy steel plate and this is connected to the end of cradle C by means of slide plates 24 so that the feeder head may slide up and down relative to the cradle. This upward and downward movement is achieved by means of hydraulic cylinder 26 which are connected to leg members 25 which support the feeder F.

The top of the feeder base 23 comprises a heavy steel plate 27 and this serves as a support for the feeder portion 28. This feeder portion 28 also has heavy steel side walls and a heavy steel base plate 29 which rests on plate 27. The top of feeder 28 is formed by another heavy steel plate 30. Extending across between the side walls of feeder 28 are rear pinch rollers 31 and front pinch rollers 32. These pinch rollers are powered by hydraulic motors and the sheet metal S passes between these rollers as illustrated. Pressure is applied to the rollers 31 and 32 by means of hydraulic cylinders 33 and 34 respectively.

In the region between rollers 31 and 32 are a series of straightening rollers 35 of conventional type. Also mounted in the region between rollers 31 and 32 is a measuring wheel 36 supported on a pivot arm 37 and this measuring wheel 36 is connected to a transducer for providing electric signals based on the length of material passing through the feeder. These signals are used to control the hydraulic system to the hydraulic motors in the manner described in the U.S. Pat. No. 3,771,703.

Figure 2:
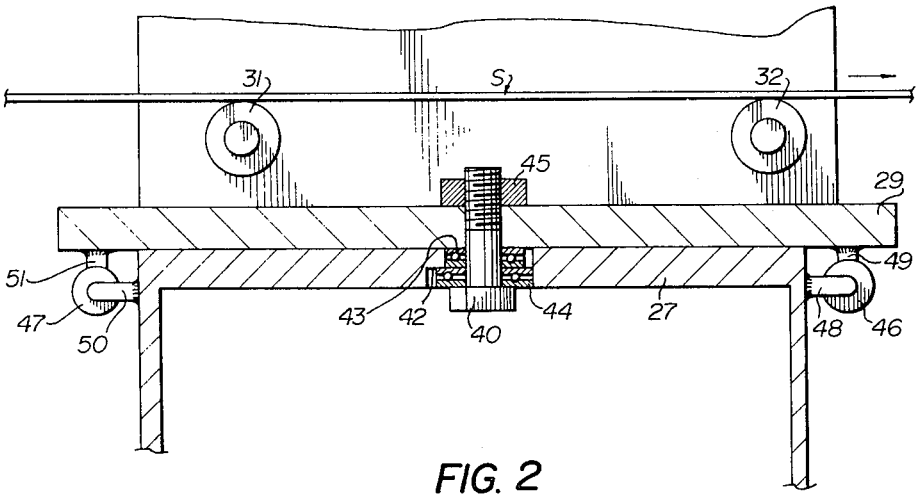
FIG. 2 is a cross sectional view showing the moveable connector assembly for the feeder head.
Figure 4:
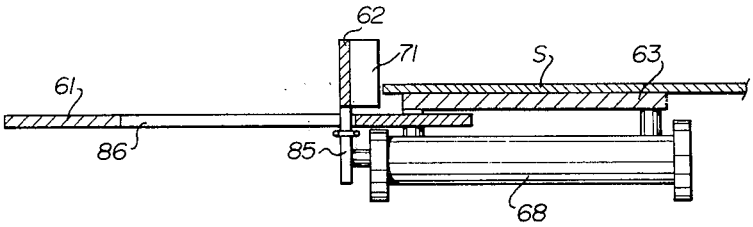
FIG. 4 is a sectional view of the edge feeler assembly.

As can be best seen from FIG. 2, the base plate 29 of feeder 28 is connected to top plate 27 of base 23 by means of a pivot bolt 40 mounted within a slot 41 in plate 27. The slot 41 includes a concentric shoulder 42 and mounted around the pivot bolt 40 within the slot 41 are a pair of bearings 43 and 44, preferably roller or needle bearings. It will be noted that the inner bearing 43 is positioned tightly against the rearward edge of slot 41 while the outer bearing 44 is positioned tightly against the forward edge of slot 41. This effectively prevents any relative forward and rearward movement between plates 27 and 29 while permitting rotation between the plates as well as lateral movement along the lateral slot 41.

At the forward end of plate 29 there is positioned a hydraulic cylinder 46 which is connected at one end to base 23 by a bracket 48 and at the other end to the plate 29 by means of bracket 49 a similar arrangement is provided at the rearward end of plate 29 with hydraulic cylinder 47 being connected at one end by a bracket 50 to the base 23 and connected at the other end to the rearward end of plate 29 via bracket 51. Thus, it will be seen that by actuation of these hydraulic cylinders 46 and 47, the feeder head 28 can be shifted laterally with respect to its base 23 or pivoted about pivot bolt 40.

Figure 3:
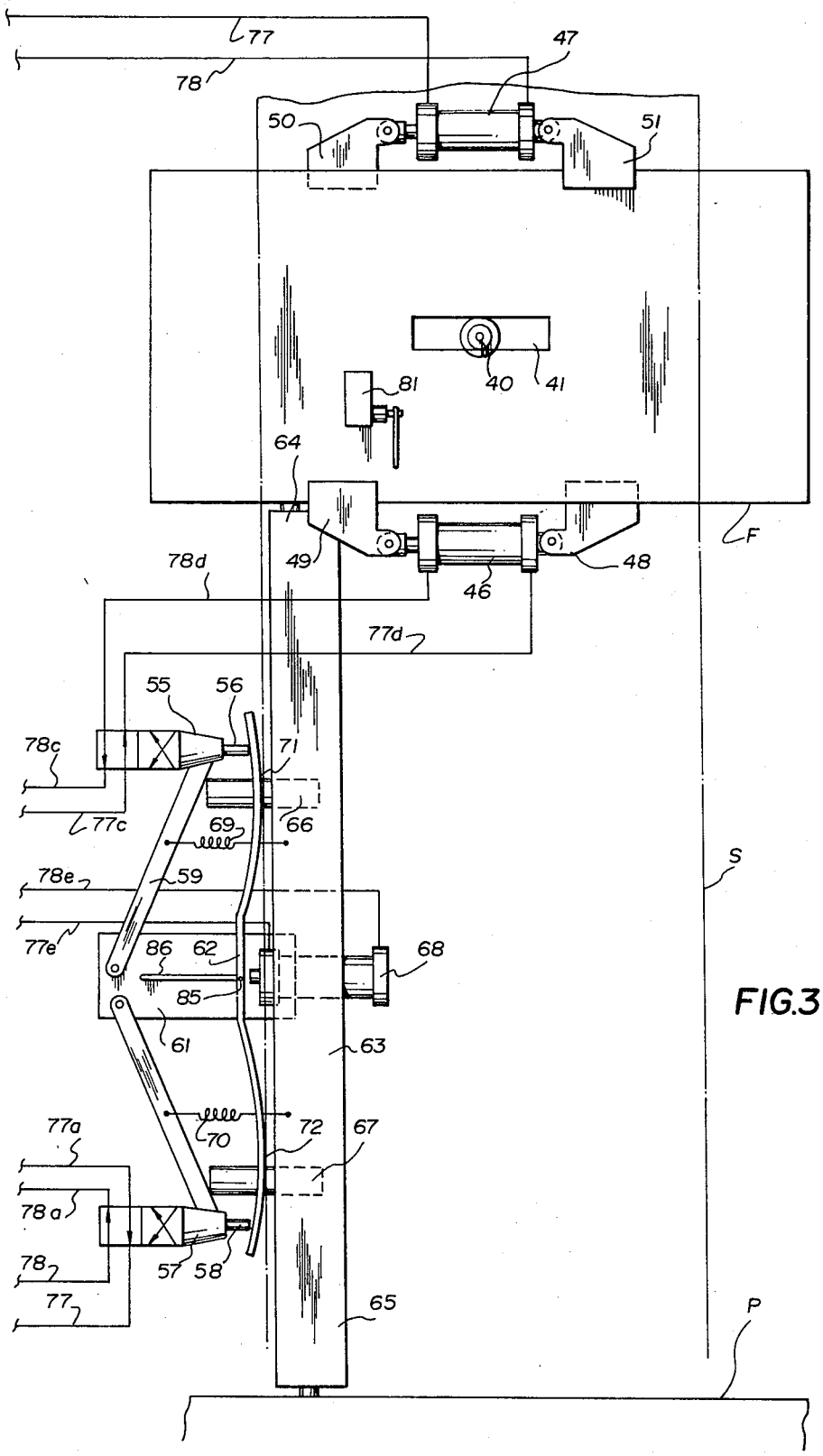
FIG. 3 is a schematic plan view of the moveable feeder head and edge feeler assembly.
Figure 5:
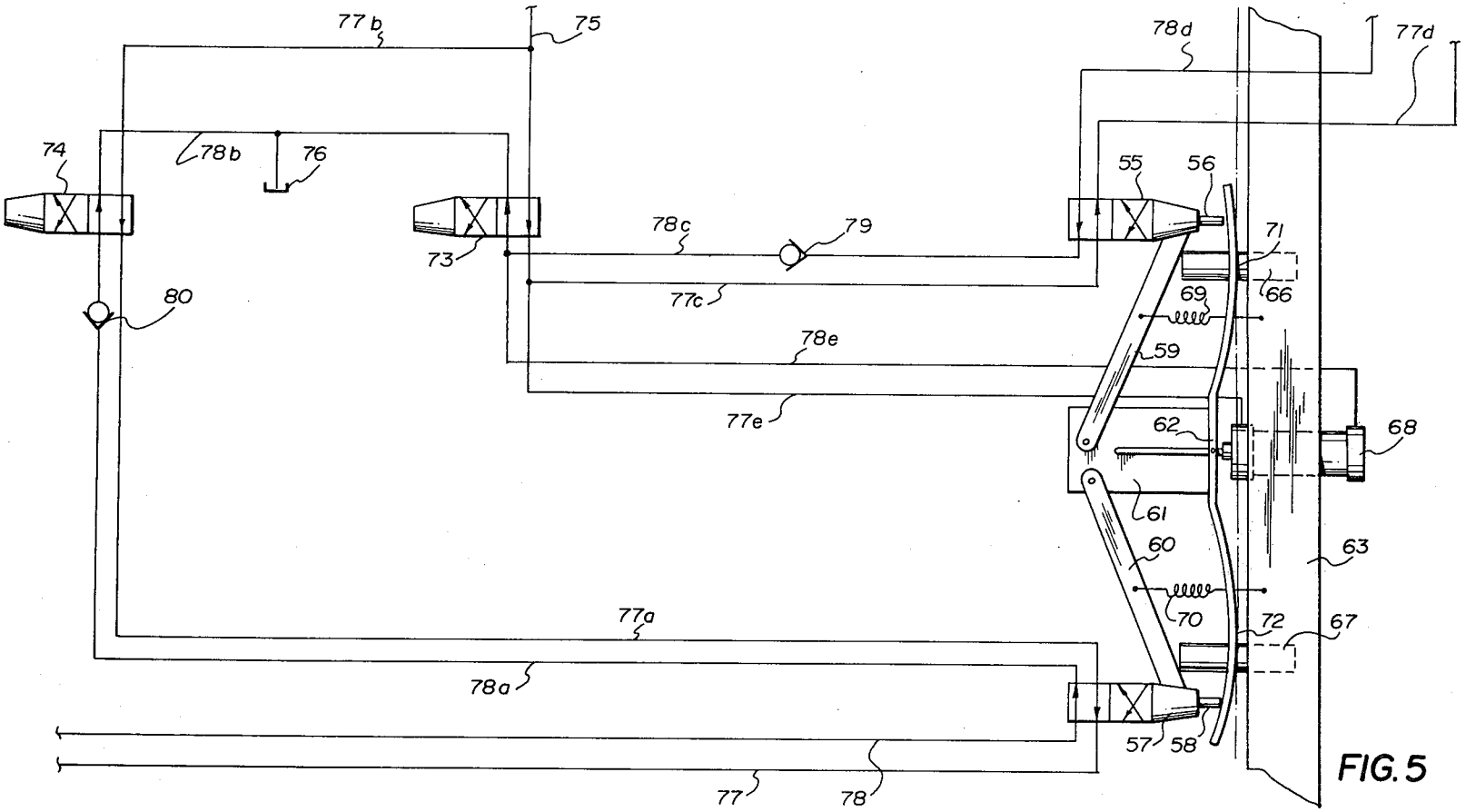
FIG. 5 is a schematic view of the hydraulic circuit.

As shown schematically in FIG. 3, the sheet metal S is being fed by the feeder F to the bed of a power press P. A pair of solenoid valves 55 and 57 are positioned adjacent one side of the travel path in a spaced relationship. These valves can conveniently be VICKERS DG 4S4–012A–50 having only one solenoid and a spring offset to return the spool to the other position. The solenoid valve 55 which is closest to the feeder has an actuating pin 56 and is mounted on a pivotal arm 59 which is pivotally mounted on a base plate 61. The solenoid valve 57 which is closest to the press also has an actuating pin 58 and is mounted on a pivotal arm 60 which is pivotally mounted to the base plate 61.

Immediately adjacent the edge of the sheet steel is a floating edge guide or feeler 62 having a straight central section and a pair of bowed portions 71 and 72 which are the actual feeler portions which engage the sheet metal. These portions 71 and 72 when moved by the sheet metal engage the solenoid valve pins 56 and 58 respectively. The edge guide is mounted on a central pivot 85 and is also slideable along a guide 86.

A support plate 63 extends between the feeder and press, being connected at end 64 to the feeder base and end 65 to the press P. Since the feeder base is adjustable vertically, the support plate moves up and down with the feeder base. Additional support plates for the sheet metal can be mounted adjacent plate 63, particularly to support the sheet metal. The base plate 61 is fixed to support plate 63.

A pair of stop bars 59 and 60 are adjustably mounted on support plate 63 and these bars act as abutments to limit the forward movement of the arms 59 and 60 towards the metal strip S. The positioning of the bars 59 and 60 determine the lateral position as well as the alignment of the desired travel path of the metal strip S. These arms 59 and 60 are, of course, being continuously urged in the forward direction by means of springs 69 and 70 which are mounted between the arms 59 and 60 and the guide plate 63.

When a new coil of sheet metal is being positioned in the feeder and being threaded through to the press, it is advantageous to be able to move the entire edge guide mechanism out of the way to avoid being damaged by the sheet metal being fed in. For this purpose a hydraulic cylinder 68 is provided which can be actuated to push on the edge guide 62, moving both it and the solenoid valves 55 and 57 away from the path of the sheet metal. When the metal is in position, the cylinder 68 is released and the edge guide and solenoid valves return back into the proper position in engagement with the stops 66 and 67.

The hydraulic cylinders and solenoid valves are, of course, connected to a hydraulic flow system. This includes a source of hydraulic pressure 75, which can conveniently be the hydraulic pump driving the feeder. Also included is a return flow tank 76 for hydraulic fluid, which can be the hydraulic fluid tank of the feeder, and two auxiliary solenoid valves 73 and 74.

Describing now the hydraulic system in detail, a hydraulic flow conduit 77 is connected to one end of cylinder 47 and this connects to solenoid valve 57. With the solenoid valves in the positions shown, this conduit emerges from valve 57 as conduit 77*a* which connects to solenoid valve 74 and continuing from solenoid valve 74 to solenoid valve 73 by way of conduit 77*b*. The hydraulic pressure 75 is applied to the leg 77*b* of the conduit 77. It emerges from solenoid 73 as two separate legs 77*c* and 77*e*. The leg 77*c* connects with solenoid valve 55 while 77*e* connects with one end of cylinder 68. The conduit 77 emerges from valve 55 as leg 77*d* which connects with one end of cylinder 46.

The return flow leg of the system is designated by the numeral 78 commencing at the opposite end of cylinder 47 to valve 57 and emerging from valve 57 as leg 78*a* to solenoid valve 74. A check valve 80 is included within the leg 78*a*. This emerges from valve 74 as leg 78*b* and this leg contains a connector to hydraulic fluid tank 76. The leg 78*b* connects to solenoid valve 73 and emerges from this valve as legs 78*c* and 78*e*. 78*c* connects to solenoid valve 55 while the leg 78*e* connects to the opposite end of cylinder 68. A further check valve 79 is included in the leg 78*c* and this leg 78*c* emerges from valve 55 as leg 78*d* which connects to the opposite end of cylinder 46.

From this it will be readily evident that the direction of travel of the cylinders 46 and 47 is determined by the positioning of the spools within the solenoid valves 55 and 57 respectively. Moreover, these valves work in the manner of servo valves, thereby providing very accurate responses to changes in the position of the sheet metal passing the edge guide.

According to another feature of the system, a steel sensing limit switch 81 can be mounted on the feeder head and this indicates a passing of the end of a coil. When the limit switch 81 is actuated by the passage of the end of a coil, this shuts off the automatic operation of the cylinders 46 and 47 and actuates solenoid valves 73 and 74. This reverses the flows through these valves so that the fluid flow moves the cylinder 68 in a direction to move the edge guide 62 and the solenoid valves 55 and 57 to a position remote from the sheet metal travel path. In this flow position, the check valves 79 and 80 prevent the automatic operation of cylinders 46 and 47.

With the edge guide 62 and valves 55 and 57 moved back from the travel path, a fresh coil of sheet metal is threaded through the system. During this procedure the cylinders 46 and 47 on the feeder head can be controlled by manual switches to initially line up the steel. With the steel in the desired position, cylinder 68 is retracted to allow the edge guide to return to its position adjacent the sheet metal. Any necessary adjustments to the stops 66 and 67 are made at this time and then the system is turned back into automatic operation.

It will, of course, be understood that the above specific description relates to one preferred embodiment only and that many variations in specific details are possible within the scope of the appended claims. For instance, the edge sensing plate can be replaced by two or more individual sensors and these sensors can be positioned along one or both sides of the sheet material travel path. It is also possible to use totally different types of edge sensors, such as lazer light detector systems which can be used to activate control valves of a hydraulic flow system.

I claim as my invention:

1. A device for feeding a coil of sheet material to a power press comprising:

a. a feeder for intermittently advancing predetermined lengths of said sheet material along a feed path, said feeder having a pair of powered gripping rollers for gripping and advancing said sheet material, said rollers being mounted on a head portion which is supported on a base with the feeder head being arranged to pivot on said base about a vertical axis and to move on said base laterally to the direction of travel of the sheet material while being fixed against movement parallel to the direction of travel of the sheet material;

b. powered means for separately laterally moving forward and rearward portions of said feeder head, and c. detector means mounted between the feeder head and power press for detecting the edge of the sheet material, including at least two detector means spaced longitudinally to the direction of travel of the sheet material and arranged to both detect the same edge of the sheet, said detector means being operatively connected to actuate said powered means for laterally moving said feeder head, whereby the feeder head laterally adjusts and/or pivots to maintain the sheet material in proper alignment within the power press feed path.

2. The device according to claim 1 wherein said powered means are hydraulic cylinders mounted for lateral movement at forward and rearward portions of the feeder head.

3. The device according to claim 2 wherein the detector means comprises laterally moveable feeler members adapted to engage the edge of the sheet material and to actuate valve means controlling fluid flow to said hydraulic cylinders, in response to lateral movement of the edge of the sheet.

4. The device according to claim 3 wherein the detector means comprises an elongated arm extending along the edge of the sheet material feed path, said arm having a central pivot and a pair of feeler portions on opposite sides of the pivot adapted to engage the edge of the sheet material, each feeler portion being laterally moveable to engage projecting actuating pins of solenoid valves controlling fluid flow to the feeder head hydraulic cylinders.

5. The device according to claim 4 wherein said solenoid valves are swingably mounted on pivot arms and are spring biased toward the sheet material, their movement towards the sheet material being limited by laterally adjustable abutment members.

6. The device according to claim 5 wherein a support plate is provided to carry the sheet material adjacent said detector means.

7. The device according to claim 6 wherein the detector means is also supported by said plate with the plate being connected at one end to the feeder and at the other end to the press.

8. The device according to claim 7 including a hydraulic cylinder adapted to move the feeler arm and solenoid valves laterally away from the sheet material travel path.

9. The device according to claim 8 including switch means on the feeder head to detect the passing of the end of a coil of sheet material, said switch means being adapted to activate said hydraulic cylinder to move the feeler arm.

10. The device according to claim 1 wherein said feeder head includes a flat bottom plate resting on a flat top plate of said base, one of said plates have a round bolt receiving opening and the other of said plates having a laterally extending slot, said slot being of stepwise configuration with a narrower portion and a wider portion joined by a horizontal lip, a smaller bearing mounted within said narrow portion and being pressed against one long edge thereof, a larger bearing mounted within said wider portion and being pressed against a long edge of said wider portion remote for said narrower portion long edge and a bolt extending through said bolt receiving opening and through said bearings to hold said bearing pressing against the respective edges and to hold said larger bearing axially against said horizontal lip.

11. A device for feeding a coil of sheet material to a power press comprising:

a. a feeder for intermittently advancing predetermined lengths of said sheet material along a feed path, said feeder having a pair of powered gripping rollers for gripping and advancing said sheet material, said rollers being mounted on a head portion which is supported on a base with the feeder head being arranged to pivot on said base about a vertical axis and to move on said base laterally to the direction of travel of the sheet material while being fixed against movement parallel to the direction of travel of the sheet material;

b. hydraulic cylinders mounted at forward and rearward portions of the feeder head to laterally separately move the forward and rearward portion of the feeder head;

c. a pair of hydraulic flow control valves spaced longitudinally to the direction of travel of the sheet material adjacent one edge of the flow path of the sheet material between the feeder head and power press, said valves controlling the direction of fluid flow to the feeder head hydraulic cylinders, and d. feelers members mounted for lateral movement and being adapted to actuate said valves in response to engagement with said sheet material edge, whereby the feeder head laterally adjusts and/or pivots to maintain the sheet material in proper alignment in response to the feeler members and valves.

12. The device according to claim 11 wherein each valve is a pin actuated solenoid valve with a spring biased spool.

13. A device for feeding a coil sheet material to a power press comprising:

a. a feeder for intermittently advancing predetermined lengths of said sheet material along a feed path, said feeder having a pair of powered gripping rollers for gripping and advancing said sheet material, said rollers being mounted on a head portion which is supported on a base with the feeder head being arranged to pivot on said base about a vertical axis and to move on said base laterally to the direction of travel of the sheet material while being fixed against movement parallel to the direction of travel of the sheet material;

b. hydraulic cylinders mounted at forward and rearward portions of the feeder head to laterally separately move the forward and rearward portions of the feeder head;

c. a pair of hydraulic flow control valves spaced longitudinally to the direction of travel of the sheet material adjacent one edge of the flow path of the sheet material between the feeder head and power press, said valves controlling the direction of fluid flow to the hydraulic cylinders and being horizontally swingable on pivot arms and spring biased toward the sheet material, their movement towards the sheet material being limited by laterally adjustable abutment members;

d. feeler members mounted for lateral movement and being adapted to actuate said valves in response to engagement with said sheet material edge, and e. a third hydraulic cylinder adapted to engage the feeler members and move the feeler member and valves laterally away from the sheet material travel path.

14. The device according to claim 13 including further valve means adapted to close the fluid response between said pair of valves and said feeder head cylinders when said third hydraulic cylinder is activated to laterally move the feeler members and valves.

* * * * *